US010024539B2

(12) United States Patent
Simmons

(10) Patent No.: US 10,024,539 B2
(45) Date of Patent: Jul. 17, 2018

(54) AXIALLY STAGED MICROMIXER CAP

(71) Applicant: General Electric Company, Schenectady, NY (US)

(72) Inventor: Scott Robert Simmons, Greenville, SC (US)

(73) Assignee: General Electric Company, Schenectady, NY (US)

( * ) Notice: Subject to any disclaimer, the term of this patent is extended or adjusted under 35 U.S.C. 154(b) by 245 days.

(21) Appl. No.: 14/863,536

(22) Filed: Sep. 24, 2015

(65) Prior Publication Data

US 2017/0089583 A1 Mar. 30, 2017

(51) Int. Cl.
*F23R 3/28* (2006.01)
*F23R 3/10* (2006.01)

(52) U.S. Cl.
CPC ..... *F23R 3/286* (2013.01); *F23R 3/10* (2013.01); *F23R 2900/03041* (2013.01)

(58) Field of Classification Search
CPC .... F23R 3/286; F23R 3/10; F23R 3/32; F23R 3/283; F23D 14/62
See application file for complete search history.

(56) References Cited

U.S. PATENT DOCUMENTS 9,341,376 B2 * 5/2016 Westmoreland, III .. F23R 3/286
2011/0016871 A1 1/2011 Kraemer et al.
2013/0029277 A1 * 1/2013 Koizumi ..... F23R 3/10 431/354
2013/0104556 A1 * 5/2013 Uhm ..... F23L 7/005 60/772
2013/0213051 A1 * 8/2013 Westmoreland, III .. F23R 3/286 60/775
2014/0019582 A1 1/2014 Kim
2014/0083110 A1 3/2014 Stewart et al.
2014/0109582 A1 4/2014 Shershnyov et al.
2014/0190169 A1 7/2014 Melton et al.
2014/0190174 A1 7/2014 Melton et al.
2014/0338344 A1 11/2014 Stewart et al.
2014/0338354 A1 11/2014 Stewart et al.

OTHER PUBLICATIONS

Extended European Search Report and Opinion issued in connection with corresponding EP Application No. 16187403.7 dated Feb. 16, 2017.

* cited by examiner

*Primary Examiner* — Pascal M Bui Pho
*Assistant Examiner* — Edwin Kang
(74) *Attorney, Agent, or Firm* — Charlotte C. Wilson; Ernest G. Cusick; Frank A. Landgraff

(57) ABSTRACT

A method of providing fuel to a combustion chamber of a combustion can in a radial direction of the combustion can, and a micromixer cap having axially arranged fuel stages that receive fuel from a radial direction, the fuel stages supplies fuel to different radial zones of micromixer tubes arranged in a concentric configuration to provide a mixture of fuel and air for combustion.

16 Claims, 20 Drawing Sheets

AXIALLY STAGED MICROMIXER CAP

This invention relates to gas turbine systems, particularly to a micromixer cap of an industrial gas turbine engine, and a method to distribute a mixture of fuel and air to a combustion chamber in a gas turbine engine.

BACKGROUND OF THE INVENTION

An industrial gas turbine includes an air inlet, an air compressor section, a combustion section, a turbine section, and an exhaust section. The combustion section includes fuel feeds and air feed that connect to combustion cans, which mixes the fuel and the air and creates combustion that supplies exhaust gas to the turbine section.

Conventionally, the combustion cans include a series of fuel tubes under an endcover in an axial end of a combustion can, a combustion chamber on the opposite axial end of the combustion can, and a variety of configurations of mixing nozzles that mixes fuel with air prior to reaching the combustion chamber. The mixing nozzles may also be micromixer configurations using the standard endcover and fuel nozzle setup to feed fuel to the micromixer tubes. The current micromixer configuration restricts the flexibility of the micromixer configuration by limiting the shape of the micromixer assembly to conform to the rounded shape of the combustion can that is tied to the fuel nozzle sector geometry and the designated fuel entry points. The current configurations also poses mechanical challenges of connecting the endcover and fuel nozzle feed to the mixing nozzles and/or micromixer assemblies inside the combustion can.

Simplification and control of the fuel tubes and mixing nozzles configurations have been in constant need of development. The improvements are sought in order to improve control of the amount of fuel used during combustion, and to improve control of the amount of combustion that is produced during operation. The simplification of the fuel input also allows easier connections from the fuel nozzle feed to the mixing nozzles and/or micromixer assemblies inside the combustion can. The simplification may allow the combustion can to be re-shaped to better match the annular sector of the turbine inlet instead of remaining round and tied to fuel nozzle geometry. The flexibility in micromixer configurations may allow further optimization of dynamics and emissions while maintaining traditional effusion cooling of the micromixer cap to limit durability risks. Costs may also be reduced due to the simplification of configurations.

BRIEF SUMMARY OF THE INVENTION

The invention provides an axially stacked configuration of fuel input in a combustion can. Fuel is provided in axially stacked fuel stages under the combustor endcover. The fuel stages include micromixer tubes that extends through the multiple fuel stages, and the micromixer tubes are initially filled with air. Fuel enters each of the fuel stages from a radial direction of the combustion can, from an inlet on a radially outer periphery of the fuel stages, and the fuel surrounds the micromixer tubes that extends through the fuel stages from one side of the stack of fuel stages that abuts the combustion chamber, to the opposite side of the stack of fuel stages that abuts an air plenum. The air plenum is located in place of where conventional fuel injector feed tubes would have be placed.

The micromixer tubes are initially filled with air supplied by the air plenum, which receives compressed air from the compressor section. Fuel enters the micromixer tubes from an injection hole in the micromixer tubes that is located in close proximity to the edge of the micromixer tube. This ensures that the fuel has ample distance in the micromixer tube to mix with the air in the tubes prior to entering the combustion chamber.

The inventive configuration of the axially stacked fuel stages simplifies the combustion can by removing the fuel nozzles while retaining fuel staging capability. The configuration provides a more space efficient and fuel efficient way of mixing fuel and air, and supplying the mixture of fuel and air to the combustion chamber. Also, the inventive configuration allows for a more steady supply of compressed air to the micromixer tubes to ensure thorough mixing of air and fuel within the micromixer tubes prior to entering the combustion chamber.

DETAILED DESCRIPTION OF THE INVENTION

Figure 1:
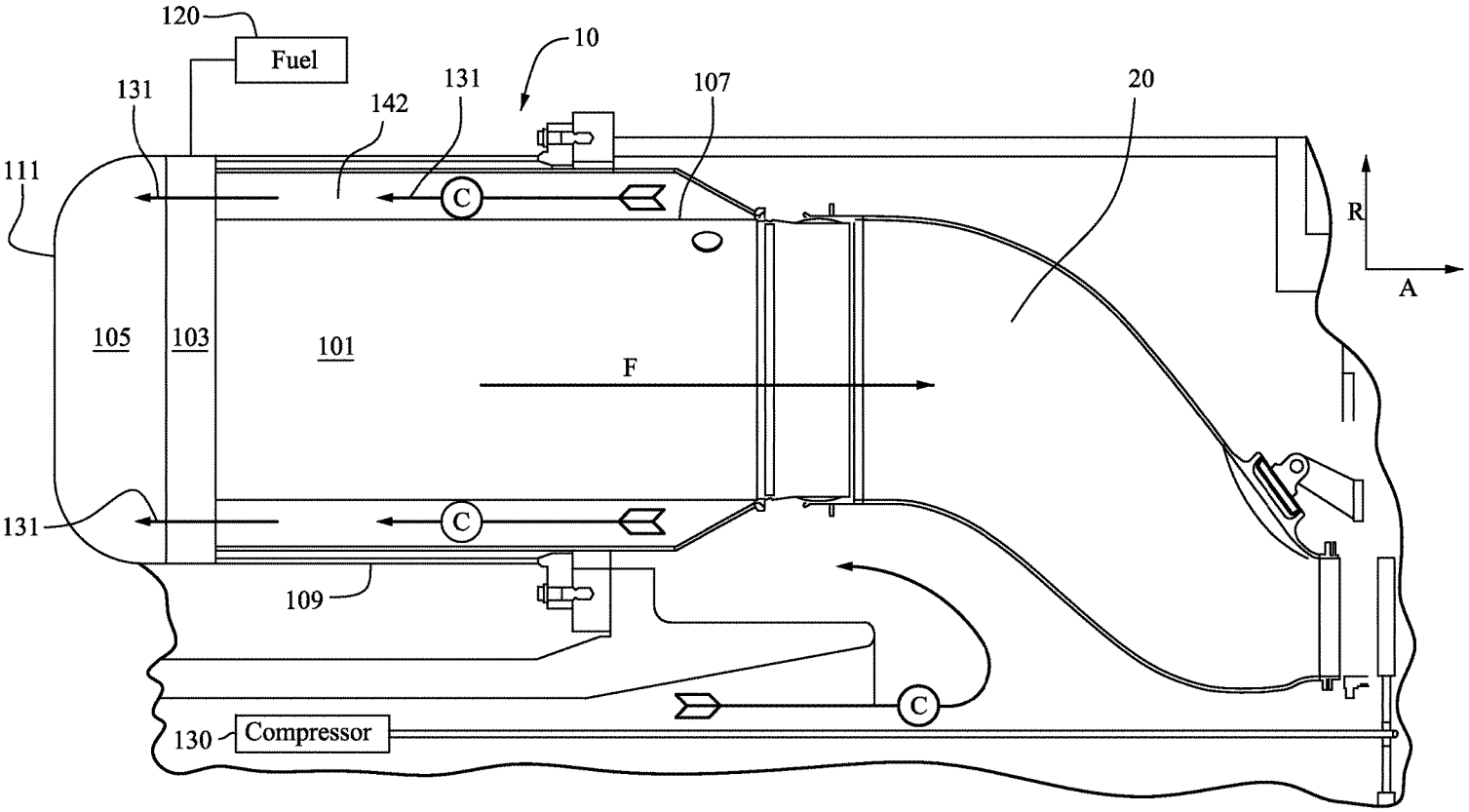
FIG. 1 is a schematic cross-sectional view of a combustion can that is connected to a compressor, a fuel source, and an exhaust duct in an industrial gas turbine.

A schematic view of the inventive combustion can configuration is shown in FIG. 1. The combustion can 10 is connected to an exhaust path 20 that directs exhaust gas in the flow direction F to a turbine section downstream of the combustion can. The combustion can includes a combustion chamber 101, and axially stacked fuel stage stack 103, and an air plenum 105. The fuel stage stack 103 is operatively connected to a fuel feed 120. The combustion chamber 101 is surrounded by a combustion liner 107, which is covered by a flow sleeve 109. A compressor airflow 131 flows in a flow path 142 formed between the flow sleeve 109 and combustion liner 107. The compressor airflow 131 is supplied by a compressor section 130 of the industrial gas turbine. In the inventive configuration, the compressed airflow 131 flows through the fuel stage stack 103 into an air plenum 105 that is enclosed by end cover 111 and fuel stack 103.

As defined in this disclosure and shown in the figures, the combustion can 10 has an axis A, which follows the flow direction F of the exhaust gas that exits the combustion can from the combustion chamber, and a radius R that extends from the axis A.

Figure 2:
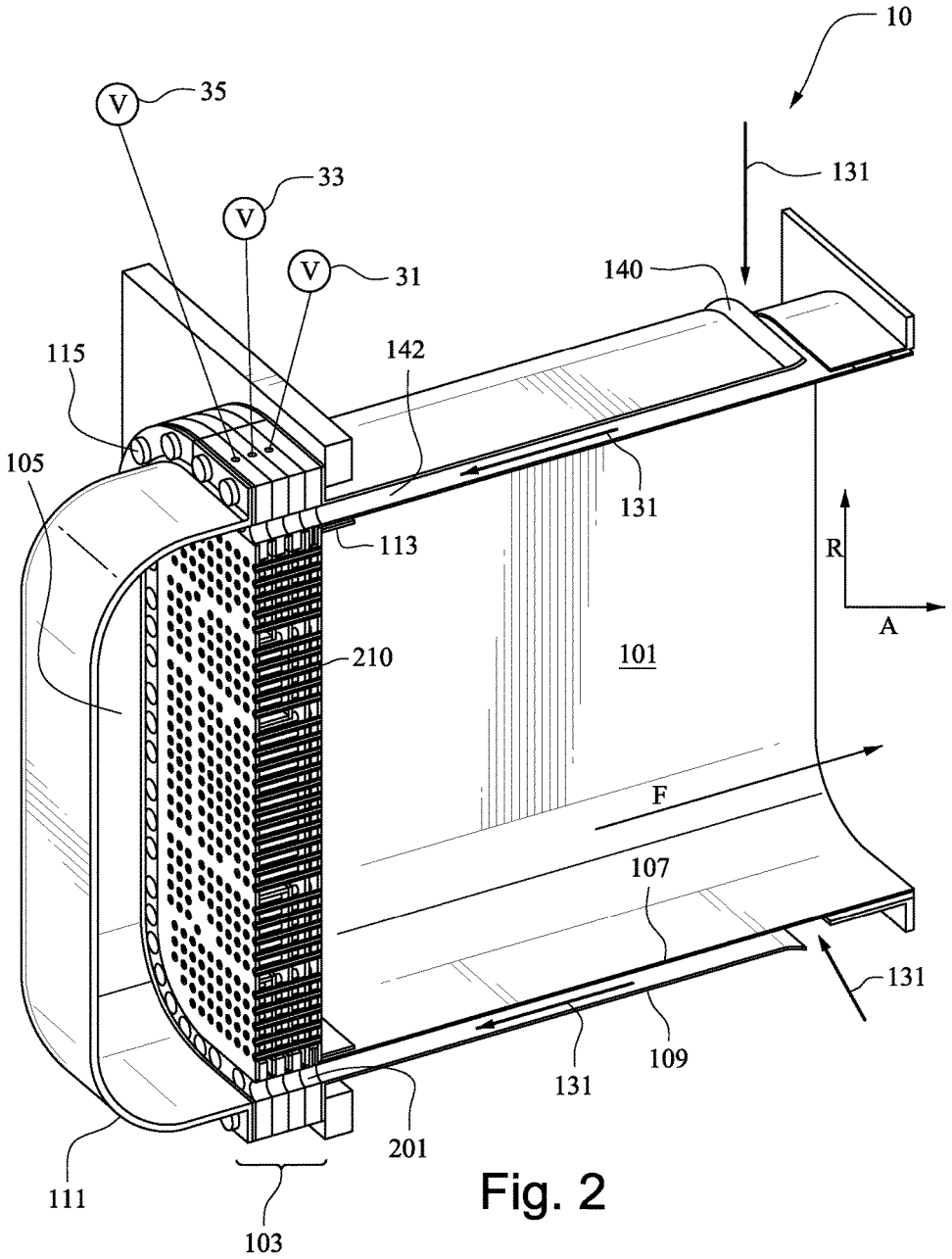
FIG. 2 is a cross-sectional view of an embodiment combustion can using the inventive configuration of axially arranged fuel stages and air supply.

An embodiment of the combustion can is shown in cross-section in FIG. 2. Compressed airflow 131 enters a flow path 142 between the flow sleeve 109 and the combustion liner 107 through an air inlet 140 in the flow sleeve 109. The compressed airflow 131 passes through air channels 201 in the fuel stage stack 103 into the air plenum 105 that is defined by the endcover 111. The compressed air 131 fills micromixer tubes 210 that extend through the fuel stage stack 103 in the flow direction F towards the combustion chamber 101.

The fuel stage stack 103 includes multiple fuel stages, and each of the fuel stages may be connected to individual control valves 31, 33, and 35 that control the amount of fuel entering each of the fuel stages, respectively. After air and fuel are mixed within the micromixer tubes 210, the mixture enters the combustion chamber 101 to be combusted to create an exhaust flow that follows an axial direction A of the combustion can. The fuel stage stack 103 includes fuel stages that are axially stacked with respect to the combustion can, and the fuel inlets of the fuel stages are located on the radially outermost portion of the fuel stages as shown in the subsequent figures.

The fuel stage stack 103 may be bolted together and fixed to other stationary structures using multiple bolts 115. The bolts 115 may also be used to seal the end cover 111 to the fuel stage stack 103, and engage the fuel stage stack 103 with the flow sleeve 109. The bolts 115 are located on the radially outermost perimeter of the fuel stage stack 103. Even if not shown in the subsequent figures, the bolts 115 may be applied to each of the fuel stages accordingly.

Figure 3:
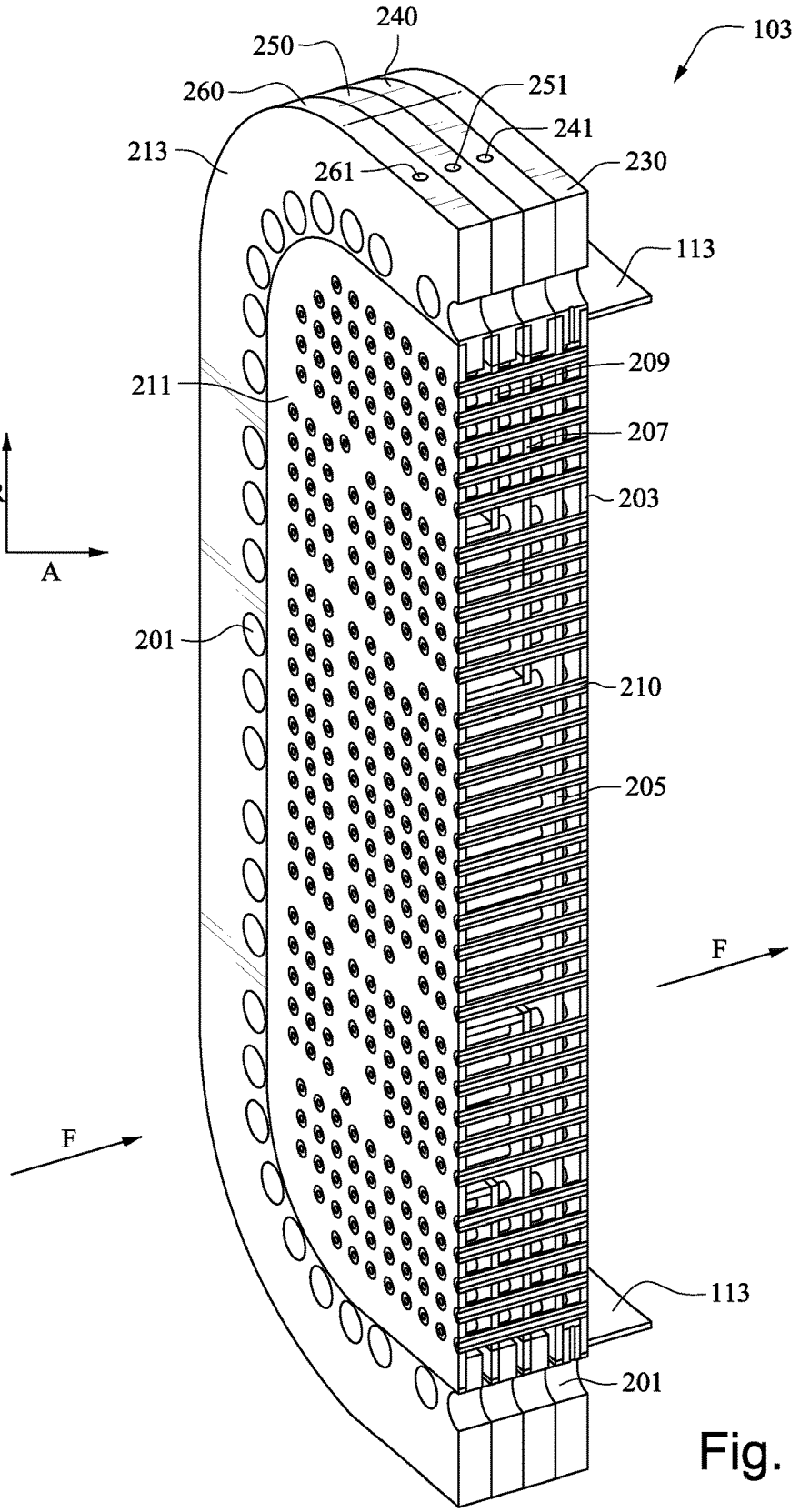
FIG. 3 is a detailed cross-sectional view of axially arranged set of fuel stages shown in FIG. 2.

A detailed cross-sectional view of the fuel stage stack is depicted in FIG. 3. The fuel stage stack 103 may include a sealing flange 113 that extends along a periphery of the fuel stage stack 103. The sealing flange 113 operatively connects the fuel stage stack 103 to the combustion liner 107, and may act as a seal or support between the fuel stage stack 103 and the combustion chamber 101.

The fuel stages in the fuel stage stack 103 are described herein from the opposite direction of the flow direction F of the combustion can, in the direction of the combustion chamber 101 towards the air plenum 105. Each fuel stage in the fuel stage stack 103 includes an annular portion 213 that houses numerous air channels 201, and the air channels 201 are placed along the radially outer perimeter of inner plates 203, 205, 207, 209, and 211 that define each of the air stage 230 and the fuel stages 240, 250, and 260. The fuel stages 240, 250, and 260 may also be known as pre-mix stages such as may be called pre-mix 1, pre-mix 2, and pre-mix 3, or PM1, PM2, and PM3.

The bolts 115 that are shown in FIG. 2 may be applied to the radially outermost perimeter of the annular portion 213 to engage the fuel stages together and keep the different combustion can structures in place.

Micromixer tubes 210 extend through the fuel stages 230, 240, 250, and 260, and may be open throughout from the air plenum 105 to the combustion chamber 101. The micromixer tubes 210 may be distributed uniformly in the radial direction of the combustion can 10. Alternatively, the micromixer tubes 210 may be distributed in different configurations that are non-linear. Micromixer tubes 210 may have additional features that enhance air/fuel mixing which vary from straight cylindrical tubes.

Figure 8:
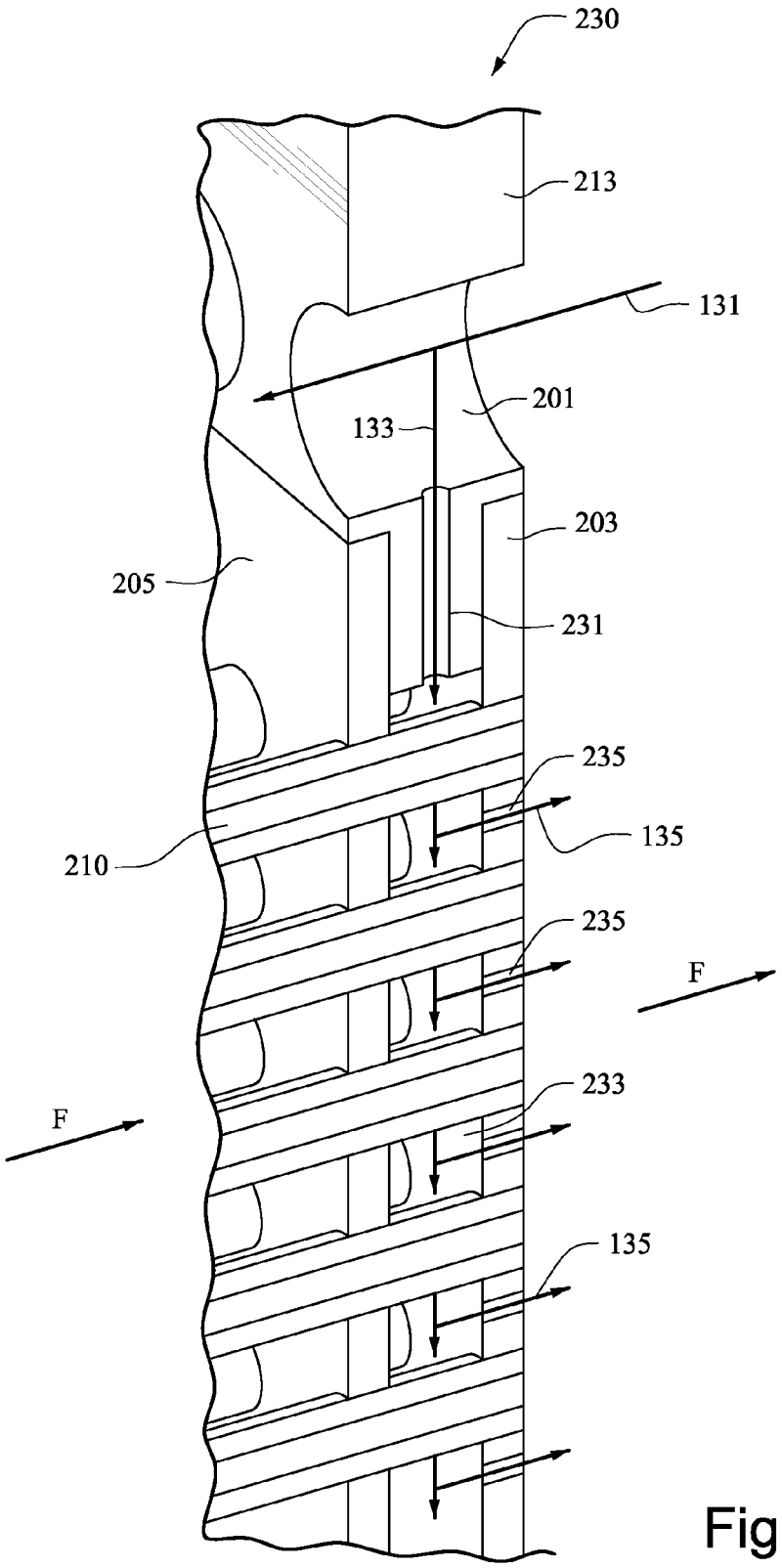
FIG. 8 is another enlarged cross-sectional view of the air stage showing further effusion cooling between the air stage and the combustion chamber.

The combustion-side inner plate 203 provides a full divider between the air stage 230 and the combustion chamber 101, except for effusion cooling holes 235 that are shown in FIG. 8.

The first inner plate 205 provides a divider between first fuel stage 240 and the air stage 230. The first inner plate 205 extends the entire radius of the inner plate, and creates a full vertical divider in the fuel stage stack 103.

The second inner plate 207 provides a divider between the second fuel stage 250 and the first fuel stage 240. The second inner plate 207 extends farther towards the inner radius of the inner plates than the third inner plate 209.

The third inner plate 209 is the second inner plate in the fuel stage stack 103 in the flow direction F. The third inner plate 209 provides a divider between the third fuel stage 260 and the second fuel stage 250. The third inner plate 209 may only extend a short distance along the radially outer perimeter of the inner plates.

The fourth inner plate 211 abuts the air plenum 105 as shown in FIGS. 1 and 2. The fourth inner plate 211 is the first inner plate in the flow direction F. The micromixer tubes 210 receive air flow from openings on the fourth inner plate 211. The fourth inner plate 211 creates a divider between the air plenum 105 and the chambers inside the air stage 230 and the fuel stages 240, 250, and 260.

Figure 4:
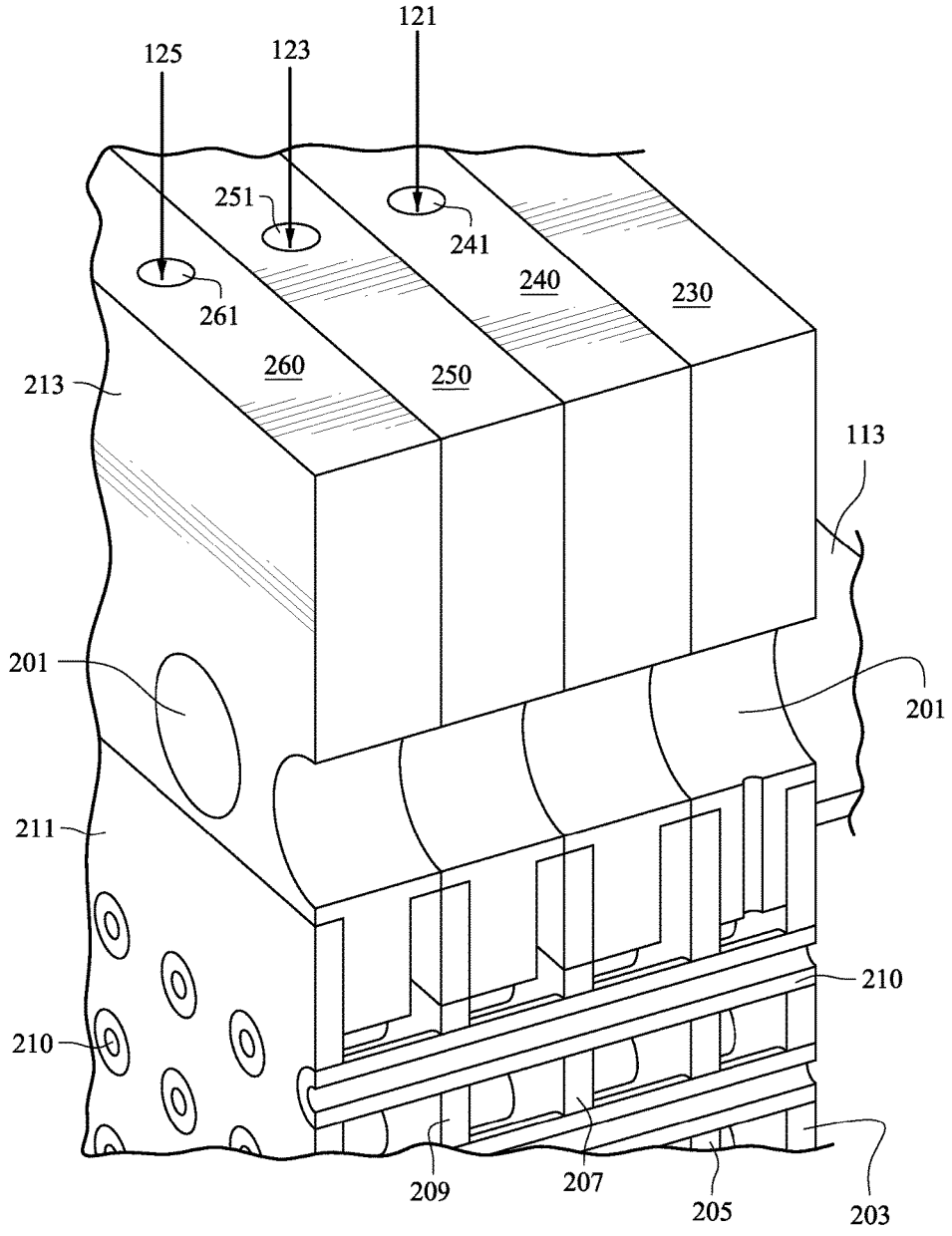
FIG. 4 is a close-up cross-sectional view of the radially outermost portion of the axially arrange set of fuel stages.

Details of the radially outer-most portion of the fuel stage stack 103 are further provided in FIG. 4. The air channels 201 extend through fuel stages 260, 250, and 240, and the air stage 230. Each of the fuel stages 260, 250 and 240 have a fuel inlet 261, 251, and 241, respectively, in the radially outermost portion edge of the annular portion 213. Air stage 230 does not have a corresponding fuel inlet in the same respective location as the other fuel stages; instead, air stage 230 is fed air by passage 231.

Each of the fuel stages 260, 250 and 240 may receive the same type of fuel, or different types of fuel, to be supplied into the respective fuel stages.

Figure 5:
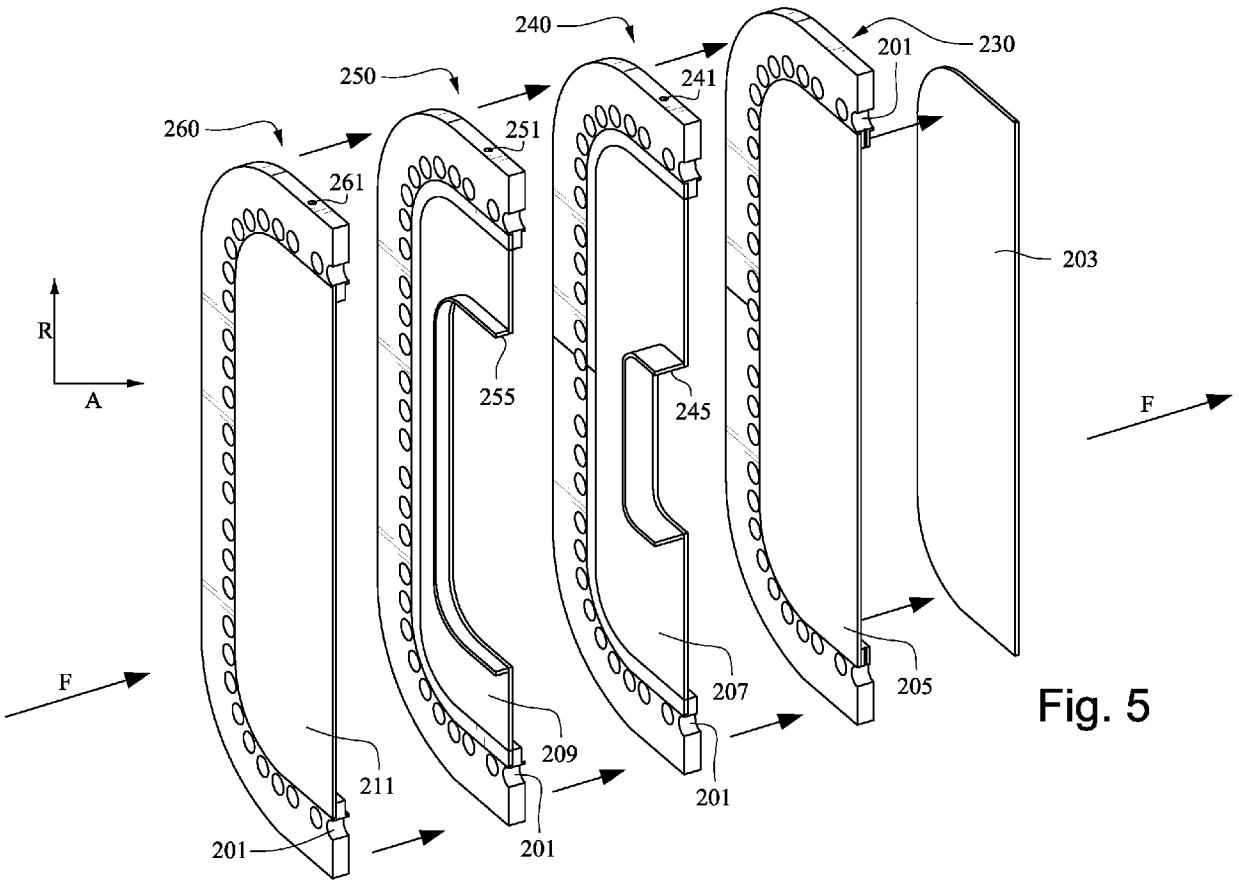
FIG. 5 is an expanded simplified view of the fuel stages without the micromixer tubes.
Figure 6:
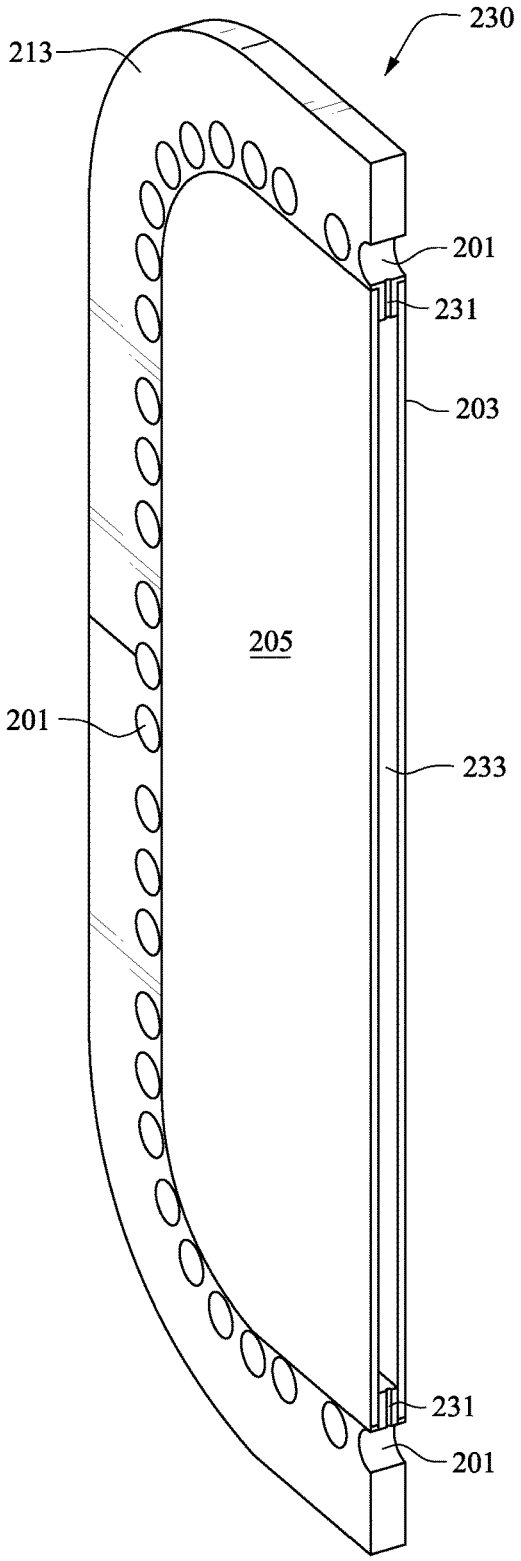
FIG. 6 is a simplified cross-sectional view of the air stage without the micromixer tubes.
Figure 7:
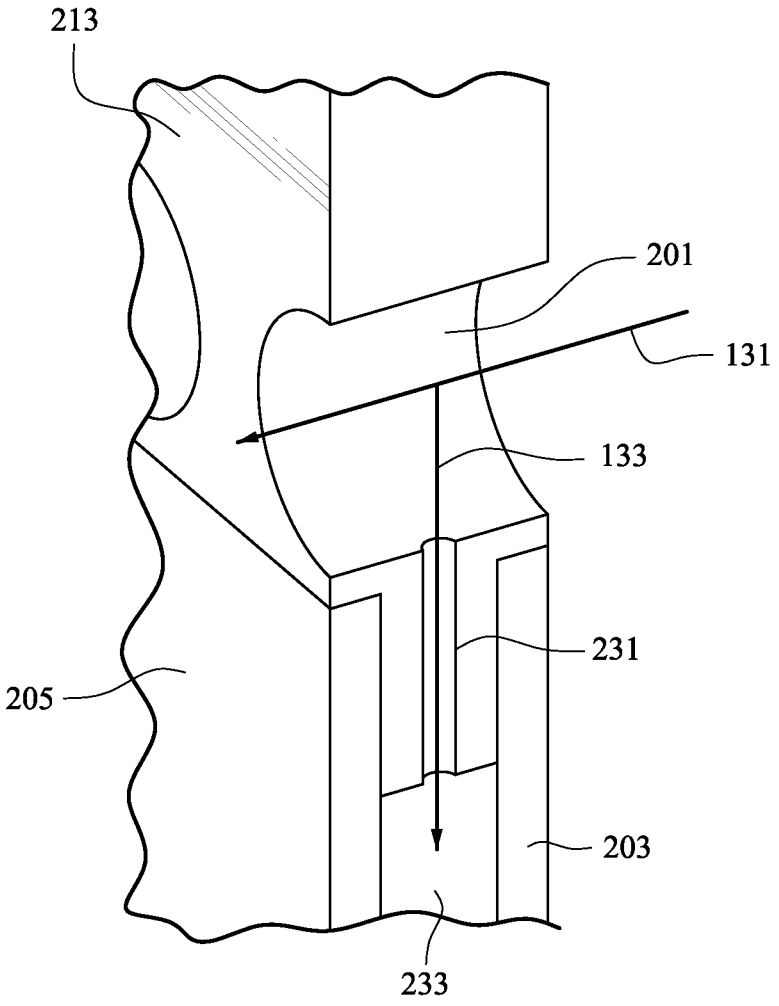
FIG. 7 is an enlarged cross-sectional view of the air stage showing the air passages that supplied air flow to the air stage.

FIG. 5 shows an exploded and simplified view of each of the fuel stages and inner plates, without the micromixer tubes or their penetrations. Details of each of the inner plates are shown, particularly for the second inner plate 207 and the third inner plate 209. The fourth inner plate 211 may be seen as an end plate for the third fuel stage 260 and the fuel stage stack 103 overall. The separate plates and fuel stages are expanded in this figure to show detail. The actual fuel stage stack 103 may be made of multiple separate pieces or may be printed as a unit, such as being manufactured by a Direct Metal Laser Melting (DMLM) process or other comparable processes.

The combustion-side inner plate 203 can be seen as an end plate for the air stage 230 and the fuel stage stack 103 overall. The combustion-side inner plate 203 is a vertical plate that extends through the entire radius of the fuel stage. The combustion-side inner plate 203 defines a chamber between the combustion-side inner plate 203, the annular portion 213, and the first inner plate 205. The chamber for the air stage 230 has the same width as a single fuel stage throughout the chamber. Shown in FIG. 8, the combustion-side inner plate 203 includes effusion cooling holes 235 that allows cooling air from the air stage 230 chamber to enter the combustion chamber 101.

The first inner plate 205 extends from the radially outermost edge of the inner plate (or extends from the radially innermost edge of the annular portion) towards the axis of the combustor can, and extends through the axial center of the combustion can. The first inner plate 205 may be seen as a radial inner plate that divides the first fuel stage 240 and from the air stage 230. The radially inner edge of the second inner plate 207 includes a lip 245 that defines a chamber in the first fuel stage 240 that is bounded by the first inner plate 205, the annular portion 213, the second inner plate 207, the lip 245 on the second inner plate 207, and the fourth inner plate 211. In other words, the chamber for first fuel stage 240 has a one-fuel-stage width between the second inner plate 207 and the first inner plate 205 in the radially outermost portion of the inner plates, and the chamber for the first fuel stage 240 has a three-fuel-stage width in the radially innermost portion on the axially center portion within the lip 245. The chamber receives the fuel supply 121 that enters through fuel inlet 241 for first fuel stage 240.

The second inner plate 207 extends from the radially outermost edge of the inner plate (or extends from the radially innermost edge of the annular portion) towards the axis of the combustor can, but does not extend to the axial center of the combustion can.

The radially inner edge of the second inner plate 207 includes a lip 245 that defines a chamber in the second fuel stage 250 that is bounded by the lip 245, the second inner plate 207, the third inner plate 209, the annular portion 213, and the third inner plate 209. The lip 245 has a two-fuel-stage width that extends in the axial direction. The lip 245 on the second inner plate 207 has double the width of the lip 255 on the third inner plate 209. The lip 245 extends beyond a lip 255 in the fuel stage stack, and seals the chamber for second fuel stage 250 with the fourth inner plate 211.

In other words, the chamber for second fuel stage 250 has a one-fuel-stage width between the third inner plate 209 and the second inner plate 207 on the radially outermost portion of the inner plates, and has a two-fuel-stage width between the lip 255 and lip 245 on the radially inner portion of the inner plates. The chamber for second fuel stage 250 receives the fuel supply 123 that enters through the fuel inlet 251.

The third inner plate 209 extends from the outer most radial edge of the inner plates towards the axis of the combustion can. The radially inner edge of the third inner plate 209 includes the lip 255 that defines a chamber in the third fuel stage 260 that is bounded by the lip 255, the third inner plate 209, the annular portion 213, and the fourth inner plate 211. The lip 255 may have a one-fuel-stage width in the axial direction of the combustion can. In other words, the chamber has a one-fuel-stage width. The chamber for third fuel stage 260 receives the fuel supply 125 that enters through the fuel inlet 261.

The area enclosed by lip 245 is sized to permit the first fuel stage 240 micromixer tubes to pass through. The area between lips 255 and 245 is sized to permit the second fuel stage 250 micromixer tubes to pass through. Similarly, the area enclosed by the outer radial perimeter of plate 209 and lip 255 is sized to permit third fuel stage micromixer tubes to pass through.

Each of the fuel stages are depicted in detail in FIGS. 6 to 18. Air stage 230 is provided in cross-section in FIGS. 6-9. The air stage 230 includes an annular portion 213 that houses numerous air channels 201 on the inner perimeter of the annular portion 213. As shown in cross section, the air chamber 233 for the air stage 230 receives air from the air channel 201 through air passage 231 that is provided at each of the air channels 201 into the air chamber 233.

As the compressed air 131 passes through air channels 201 in the annular portion 213, the compressed air 131 is directed to the air plenum 105 under the endcover 111. A second air flow 133 is divided from the compressed air 131 to pass through the air passage 231 and to enter the air chamber 233 that is defined by the combustion-side inner plate 203, the annular portion 213, and the first inner plate 205. Within the air chamber 233, the second air flow 133 creates a cooling flow barrier between the combustion chamber 101 and the fuel stages 240, 250, and 260. Pin holes 235 may be added to provide air passages between air stage 230 to the combustion chamber 101. The pin holes 235 extend through the combustion-side inner plate 203, and may provide a third air flow 135 that is used to cool the surface of the combustion-side inner plate 203 in the combustion chamber 101.

As known conventionally, a micromixer tube is used to premix air and fuel in an efficient way by providing an air conduit that includes a fuel inlet on an upstream portion of the air conduit, and allowing the fuel to mix with the air inside the micromixer tube, for example, with the aid of a kink in the tube that forces the air and fuel from a laminar flow to a turbulent flow prior to exiting the tube.

Figure 9:
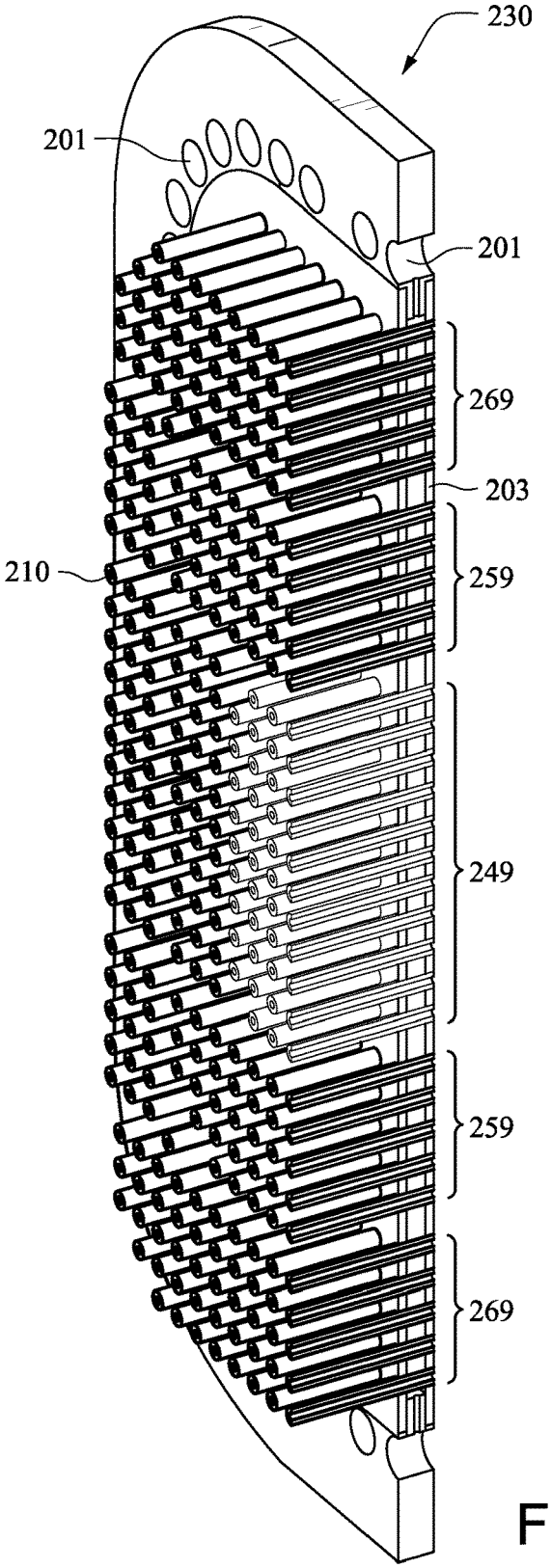
FIG. 9 is a cross-sectional view of the air stage that includes the micromixer tubes depicted in three radial zones.

Applying the conventional micromixer tubes in the present configuration, each of the micromixer tubes 210 in the fuel stage stack 103 extends through the air stage 230 and each of the fuel stages 240, 250 and 260. The micromixer tubes 210 are zoned according to each of the different fuel chambers and fuel stage from which the micromixer tubes 210 would receive fuel. As schematically depicted in FIG. 9 with the air stage 230, the micromixer tubes 210 are zoned in a concentric configuration in a radial direction of the combustion can. The radially outermost zone 269 of the micromixer tubes 210 receives fuel from the third fuel stage 260, the radially intermediate zone 259 of the micromixer tubes 210 receives fuel from the second fuel stage 250, and the radially innermost zone 249 of the micromixer tubes 210 receives fuel from the first fuel stage 240.

Figure 10:
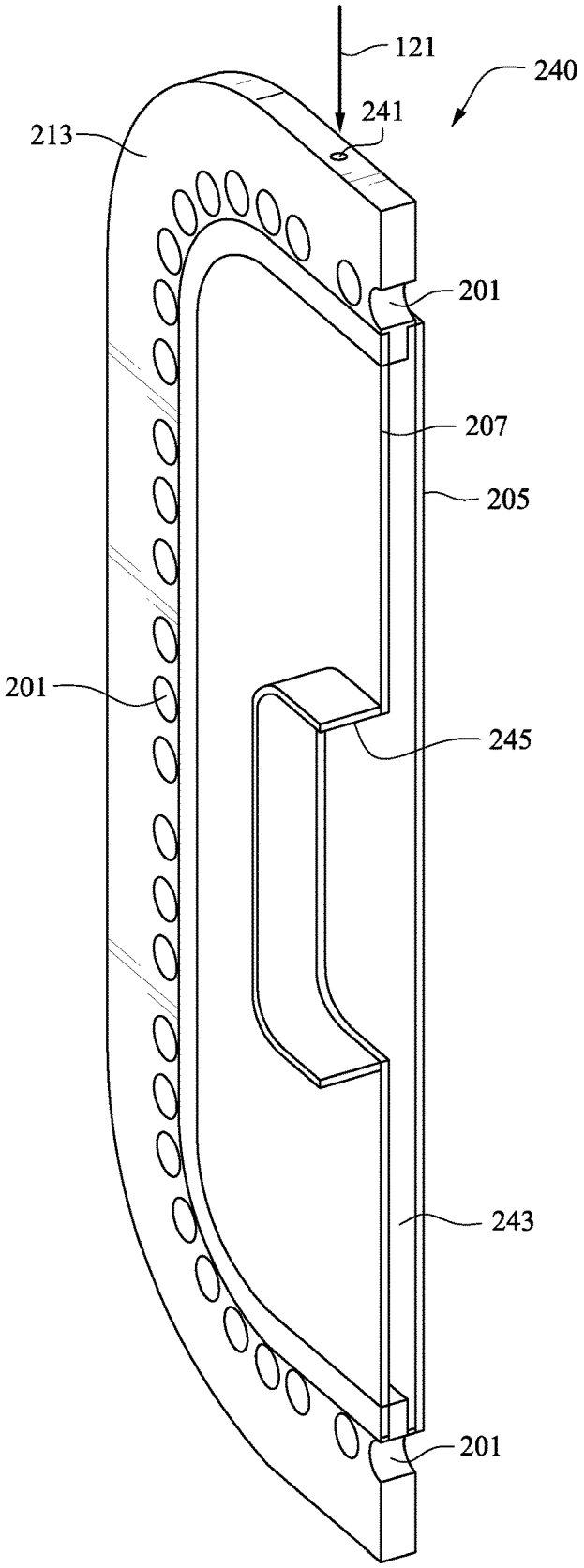
FIG. 10 is a schematic simplified cross-sectional view of the first fuel stage without the micromixer tubes.
Figure 11:
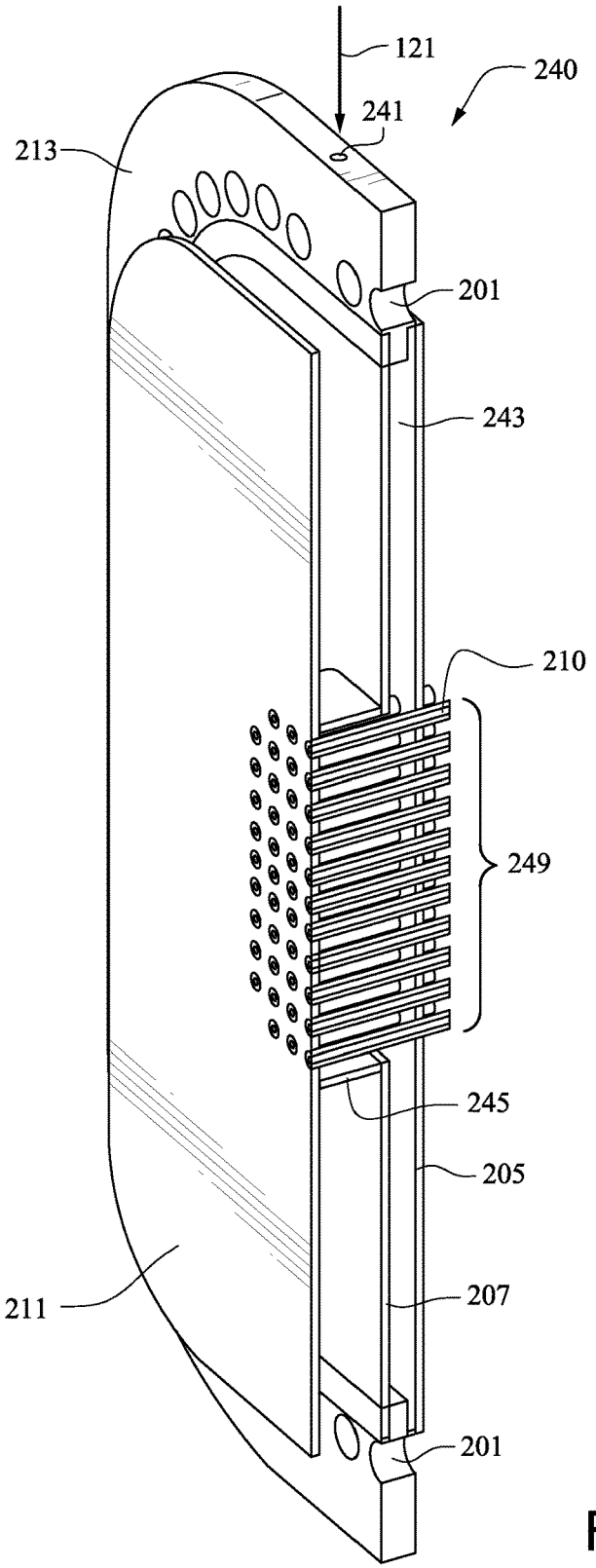
FIG. 11 is a schematic cross-sectional view of the first fuel stage with the micromixer tubes and the fourth inner plate that acts at an end plate to the fuel chamber of the first fuel stage.
Figure 12:
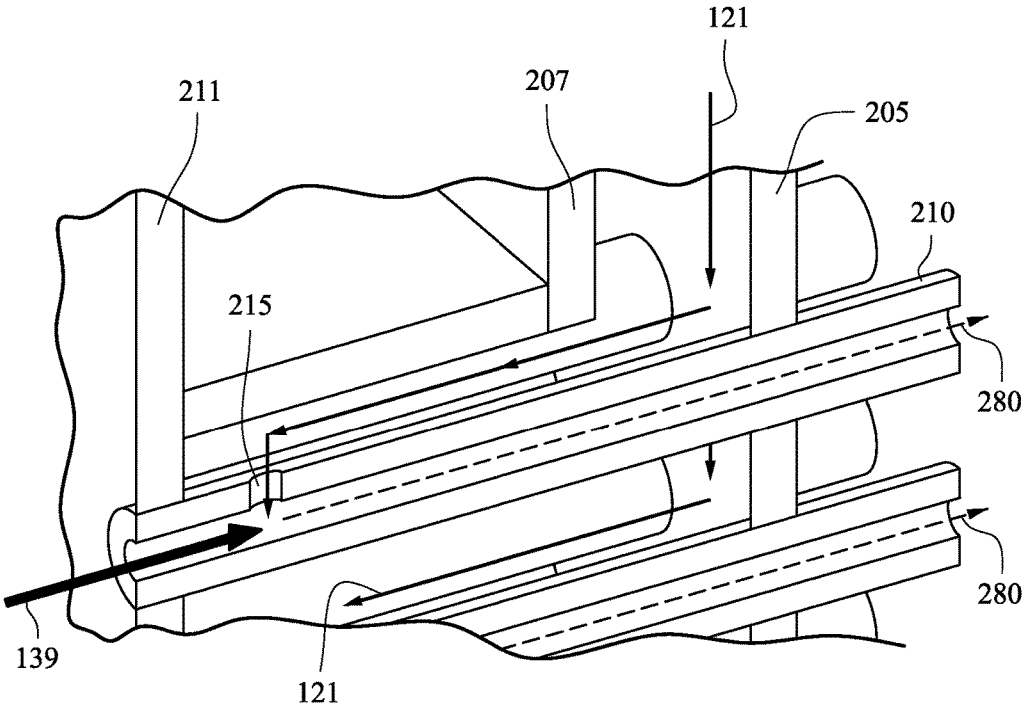
FIG. 12 is an enlarged cross-sectional view of the first fuel stage showing the mixing of fuel and air inside the micromixer tube.

The first fuel stage 240 is depicted schematically in cross-section in FIGS. 10-12. The first fuel stage 240 includes an annular portion 213 that houses numerous air channels 201 on the inner perimeter of the annular portion 213. The compressed air from the air channels 201 does not enter the first fuel stage 240. A fuel inlet 241 is provided on the radially outermost edge of the annular portion 213 for the first fuel stage 240. First fuel 121 may enter the fuel inlet 241, and fill the first fuel chamber 243 for the first fuel stage 240. The first fuel 121 only fills the first fuel chamber 243 as defined by the first inner plate 205, the annular portion 213, the second inner plate 207, the lip 245, and the fourth inner plate 211 that closes the first fuel chamber 243 (as shown in FIG. 11). The first fuel chamber 243 extends three fuel stages wide from the first inner plate 205 to the fourth inner plate 211.

The portion of the first fuel chamber 243 that is three stages wide, with the lip 245, defines the radially innermost zone 249 of the micromixer tubes 210. The micromixer tubes 210 that are applied in the radially innermost zone 249 extends through the entire fuel stage stack 103, and are immersed in the first fuel 121 in the first fuel chamber 243 that is three stages wide in the axial direction.

The first fuel 121 fills the first fuel chamber 243 and provides fuel to the micromixer tube 210 through at least one injection hole 215 on the micromixer tube 210 on an upstream portion of the micromixer tube 210, preferably as close to the inlet of the micromixer tube 210 as possible to ensure sufficient time in the micromixer tube to [[tube]] create a thorough mixture 280 of the air flow 139 and the first fuel 121 prior to exiting the micromixer tube 210 into the combustion chamber 101. The first fuel 121 travels the width of three fuel stages in first fuel chamber 243 for first fuel stage 240.

Figure 13:
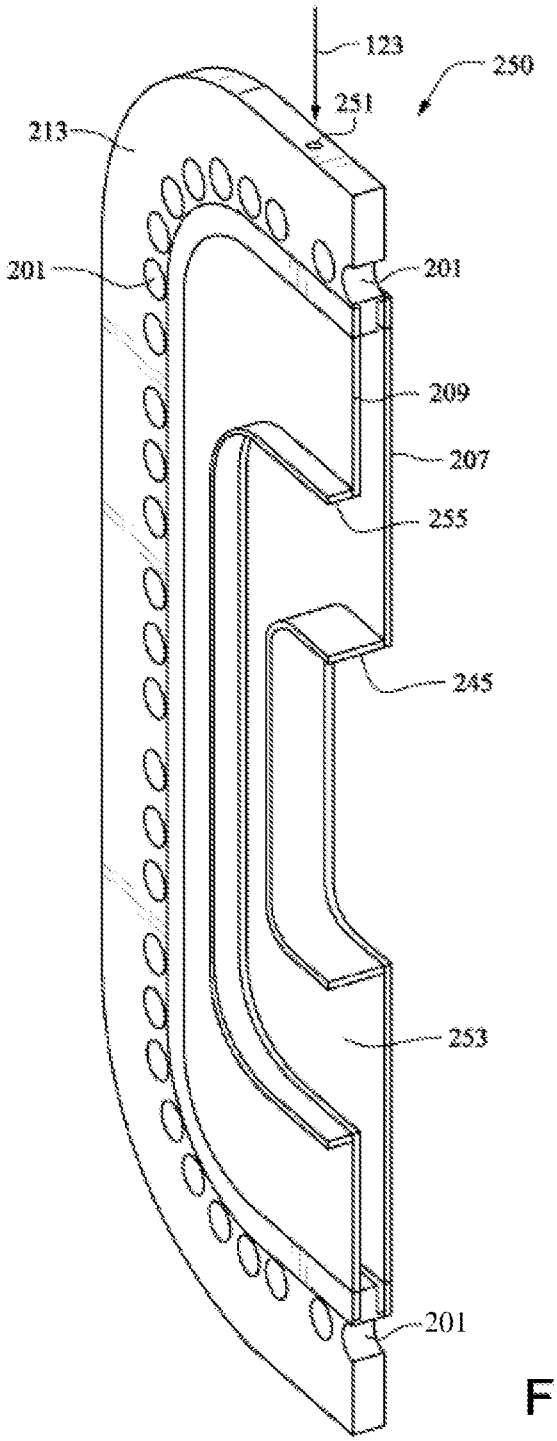
FIG. 13 is a schematic simplified cross-sectional view of the second fuel stage without the micromixer tubes.
Figure 14:
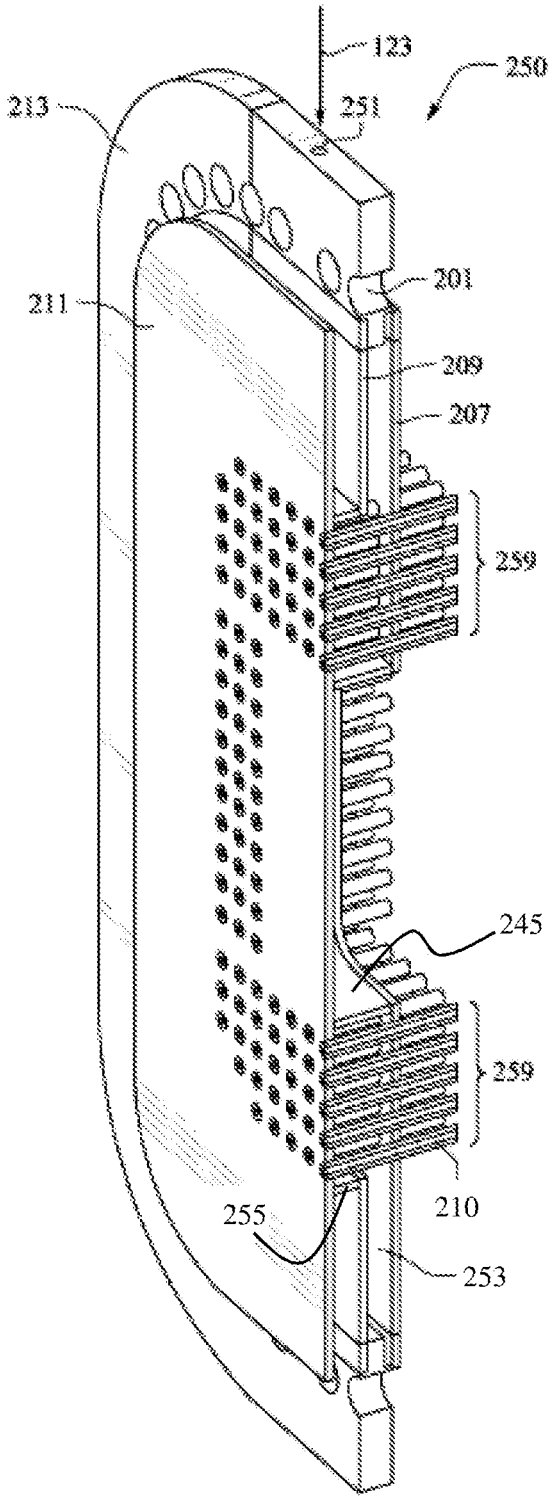
FIG. 14 is a schematic cross-sectional view of the second fuel stage with the micromixer tubes and the fourth inner plate that acts at an end plate to the fuel chamber of the second fuel stage.
Figure 15:
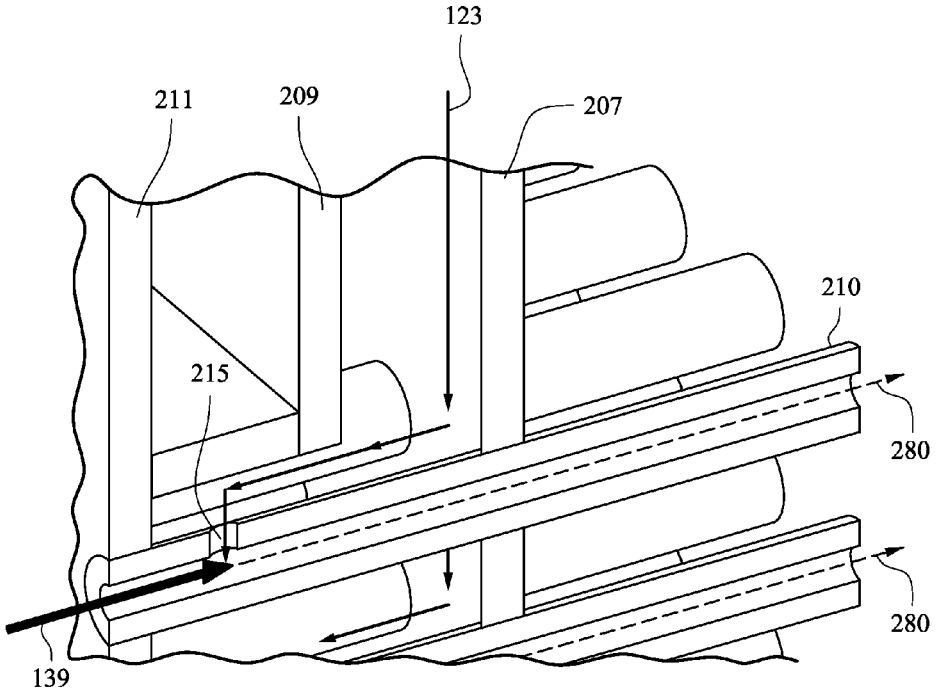
FIG. 15 is an enlarged cross-sectional view of the second fuel stage showing the mixing of fuel and air inside the micromixer tube.

Similarly, the second fuel stage 250 is depicted schematically in cross-section in FIGS. 13-15. The second fuel stage 250 includes an annular portion 213 that houses numerous air channels 201 on the inner perimeter of the annular portion 213. The compressed air from the air channels 201 does not enter the second fuel stage 250. A fuel inlet 251 is provided on the radially outermost edge of the annular portion 213 for the second fuel stage 250. Second fuel 123 may enter the fuel inlet 251, and fill the second fuel chamber 253 for the second fuel stage 250. The second fuel 123 only fills the second fuel chamber 253 as defined by the second inner plate 207, the lip 245 extending from the second inner plate 207, the annular portion 213, the third inner plate 209, the lip 255 extending from the third inner plate 209, and the fourth inner plate 211 that closes the second fuel chamber 253. The second fuel chamber 253 extends two fuel stages wide between lip 245 and lip 255 from the second inner plate 207 to the fourth inner plate 211.

The portion of the second fuel chamber 253 that is two stages wide, between the lip 245 and the lip 255, defines the radially intermediate zone 259 of the micromixer tubes 210. The micromixer tubes 210 that are disposed in the radially intermediate zone 259 extend through the entire fuel stage stack 103, and are immersed in the second fuel 123 in the second fuel chamber 253 that is two stages wide in the axial direction.

The second fuel 123 fills the second fuel chamber 253 and provides fuel to the micromixer tube 210 through at least one injection hole 215 on the micromixer tube 210 on an upstream portion of the micromixer tube 210, preferably as close to the inlet of the micromixer tube 210 as possible to ensure sufficient time in the micromixer tube to create a thorough mixture 280 of the air flow 139 and the second fuel 123 prior to exiting the micromixer tube 210 into the combustion chamber 101. The second fuel 123 travels the width of two fuel stages in second fuel chamber 253 for second fuel stage 250.

Figure 16:
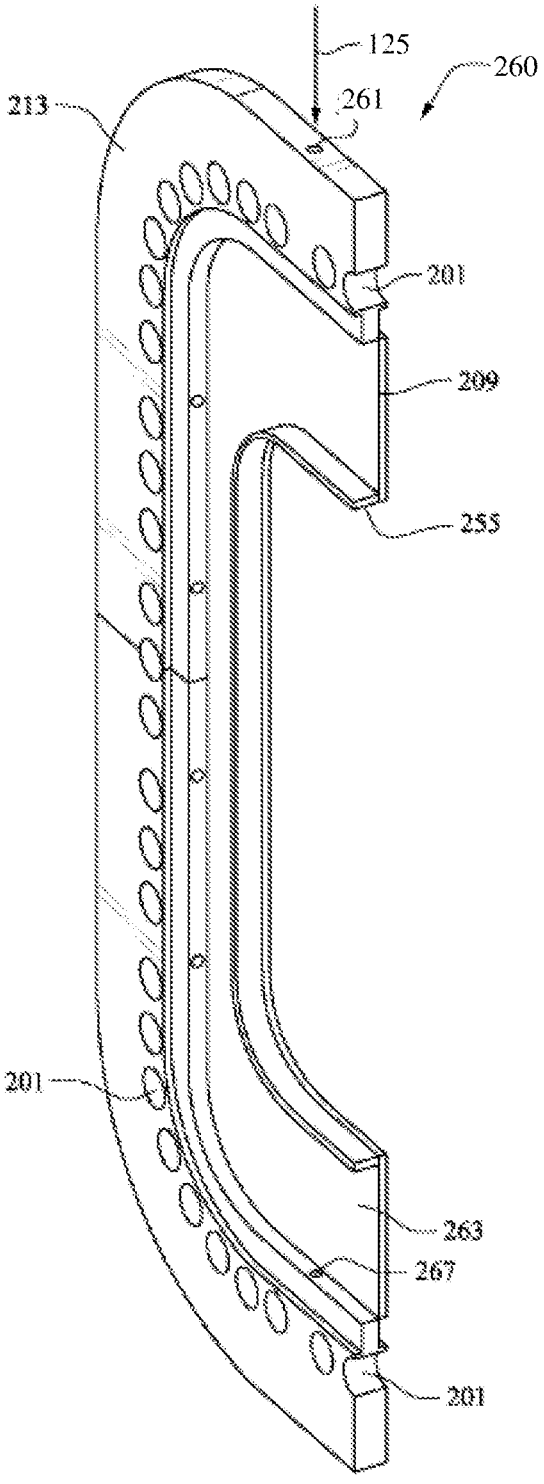
FIG. 16 is a schematic simplified cross-sectional view of the third fuel stage without the micromixer tubes.
Figure 17:
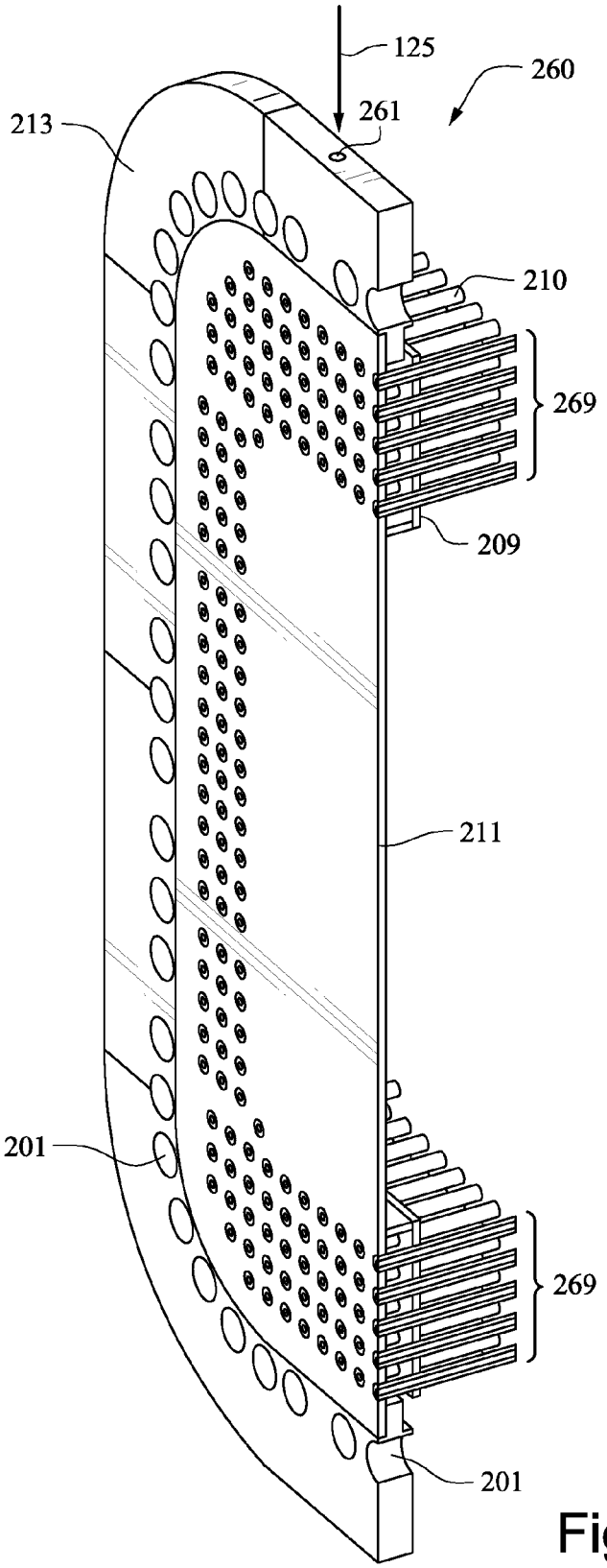
FIG. 17 is a schematic cross-sectional view of the third fuel stage with the micromixer tubes and the fourth inner plate that acts at an end plate to the fuel chamber of the third fuel stage.
Figure 18:
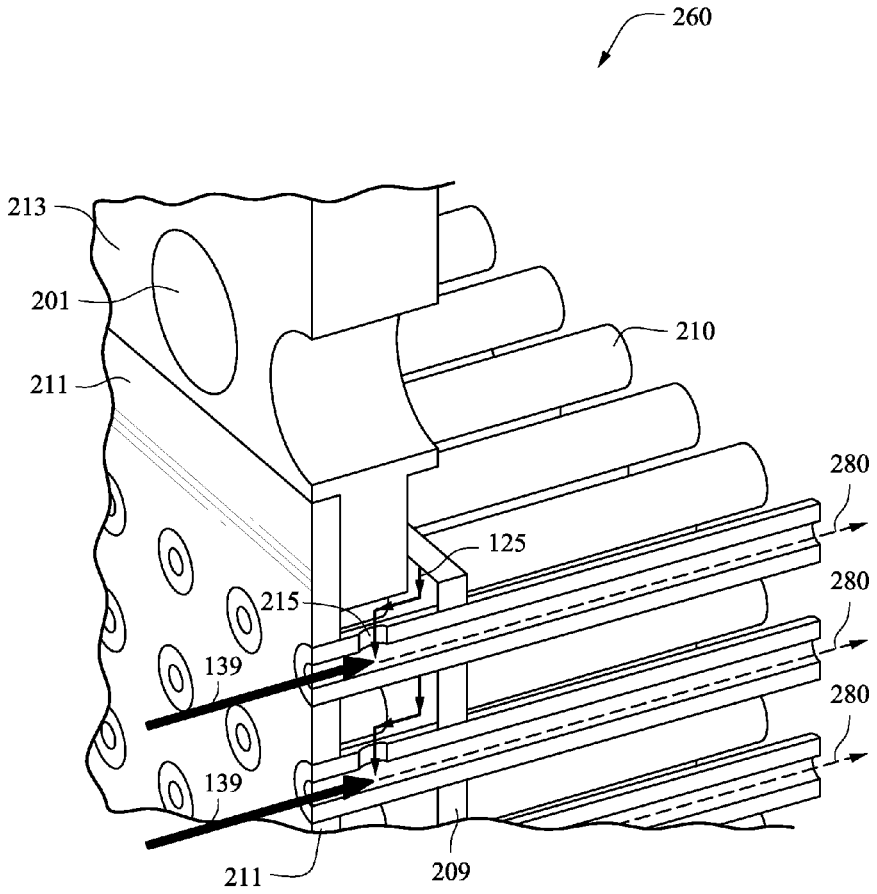
FIG. 18 is an enlarged cross-sectional view of the third fuel stage showing the mixing of fuel and air inside the micromixer tube.

Similarly, the third fuel stage 260 is depicted schematically in cross-section in FIGS. 16-18. The third fuel stage 260 includes an annular portion 213 that houses numerous air channels 201 on the inner perimeter of the annular portion 213. The compressed air from the air channels 201 does not enter the third fuel stage 260. A fuel inlet 261 is provided on the radially outermost edge of the annular portion 213 for the third fuel stage 260. Third fuel 125 may enter the fuel inlet 261, and fill the third fuel chamber 263 for the third fuel stage 260. The third fuel 125 only fills the third fuel chamber 263 as defined by the third inner plate 209, the lip 255 extending from the third inner plate 209, the annular portion 213, and the fourth inner plate 211 that closes the third fuel chamber 263. The third fuel chamber 263 extends one fuel stage wide from the third inner plate 209 to the fourth inner plate 211, defined by lip 255.

As shown in FIG. 16, fuel may be distributed to different portions of the third fuel chamber 263 through fuel distribution holes 267. The fuel distribution holes may also be present in the first fuel chamber 243 and the second fuel chamber 253 to distribute the first fuel 121 and the second fuel 123, respectively.

The portion of the third fuel chamber 263 that is one stage wide, between the lip 255 and the annular portion 213, defines the radially outermost zone 269 of the micromixer tubes 210. FIG. 17 shows that the micromixer tubes 210 that are disposed in the radially outermost zone 269 extend through the entire fuel stage stack 103, and are immersed in the third fuel 125 in the third fuel chamber 263 that is only one stage wide in the axial direction.

Shown in FIG. 18, the third fuel 125 fills the third fuel chamber 263 and provides fuel to the micromixer tube 210 through at least one injection holes 215 on the micromixer tube 210 on an upstream portion of the micromixer tube 210, preferably as close to the inlet of the micromixer tube 210 as possible to ensure sufficient time in the micromixer tube to create a thorough mixture 280 of the air flow 139 and the third fuel 125 prior to exiting the micromixer tube 210 into the combustion chamber 101. The third fuel 125 travels the width of one fuel stage in third fuel chamber 263 for third fuel stage 260.

The injection holes 215 on the micromixer tubes 210 are preferably located on the same axial plane in all of the radially outermost zone 269, the radially intermediate zone 259, and the radially innermost zone 249.

The present configuration provides a method of controlling the rate of combustion by having the ability to provide fuel to only selective portions of the micromixer tubes through the fuel stages. For example, fuel may be only provided to first fuel stage 240 such that only the radially innermost zone 249 of micromixer tubes receive fuel supply, and thus only the radially innermost zone 249 would provide a mixture of fuel and air for combustion. The other two fuel stages and corresponding micromixer tube zones may only provide air supply to the combustion chamber.

The same technique can be applied to the fuel stages in various combinations. In addition, the amount of fuel supplied to the fuel stage stack may also be varied depending on the preferred settings during combustion.

Figure 19:
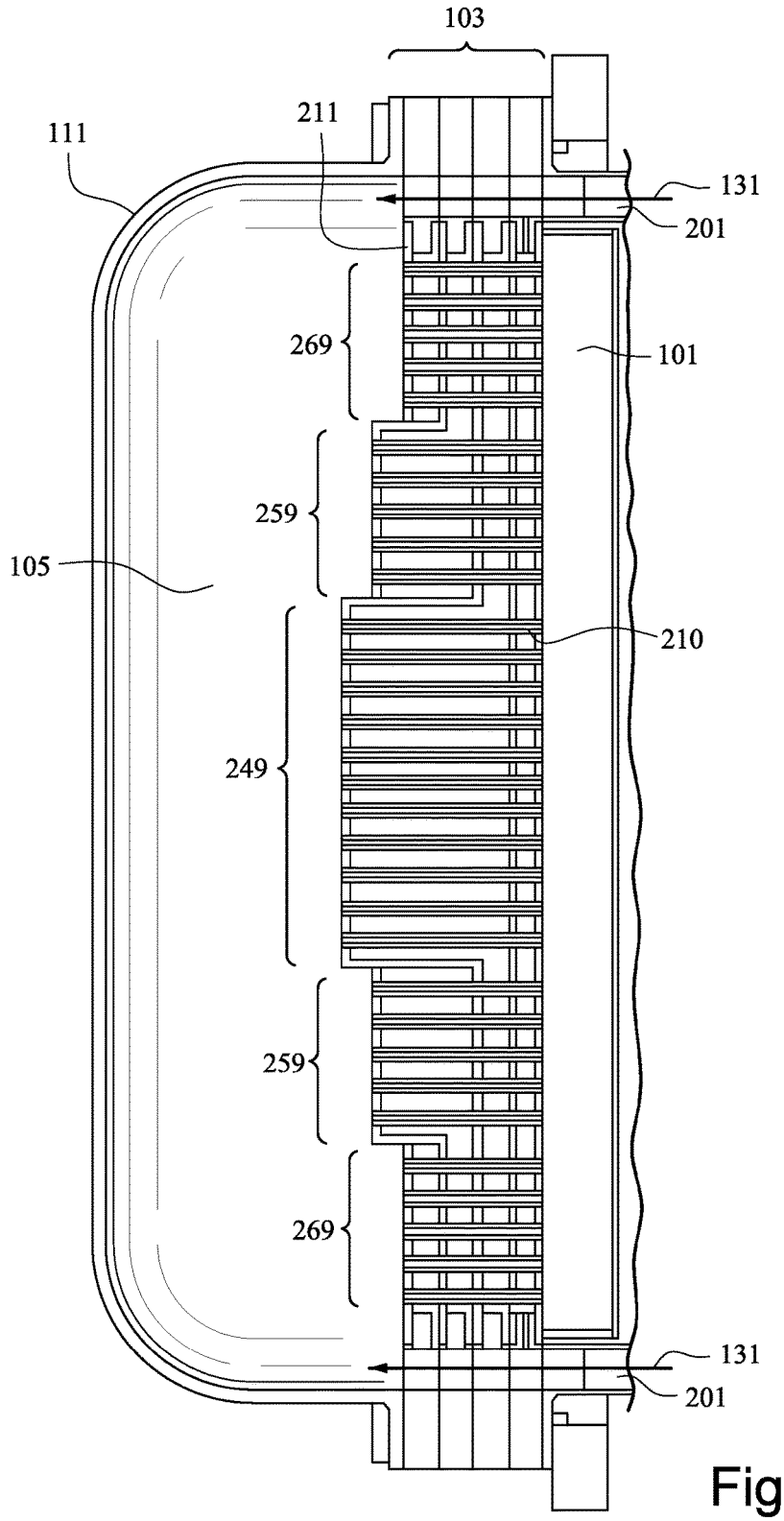
FIG. 19 shows a cross-sectional view of an embodiment configuration with a linear multi-tau configuration of the micromixer tubes in the fuel stage stack.

In another embodiment, the micromixer tubes 210 may have a multi-tau configuration such that the micromixer tubes 210 in the different radial zones are in different heights inside the air plenum 105. The fourth inner plate 211 follows the multi-tau configuration of the micromixer tubes 210. FIG. 19 shows an example of a linear configuration, in which the fourth inner plate 211 of the radially innermost zone 249 protrudes out the farthest from into the air plenum 105, the fourth inner plate 211 of the radially intermediate zone 259 protrudes a shorter distance than the radially innermost zone 249, and the radially outermost zone 269 does not protrude out of the fourth inner plate 211.

Figure 20:
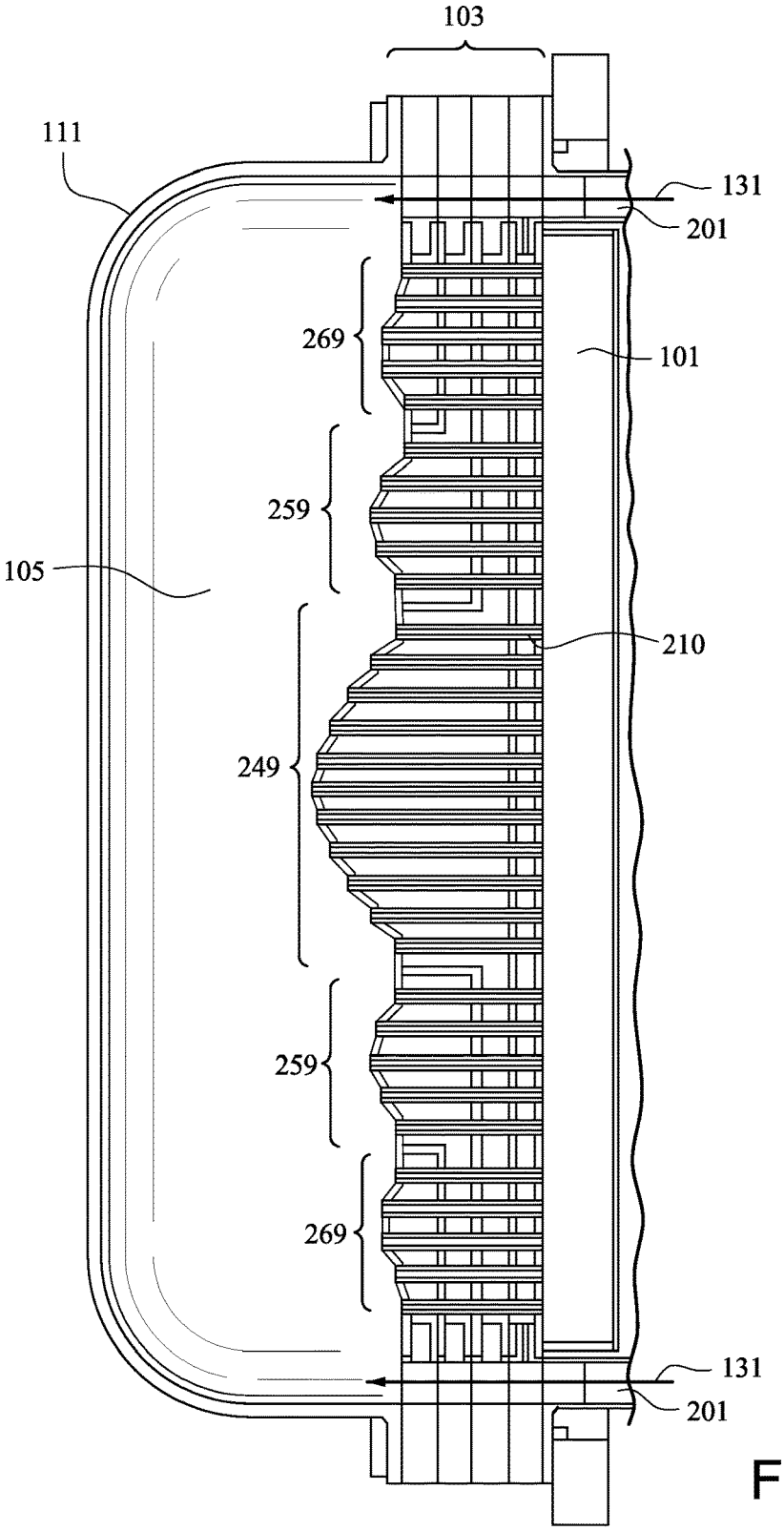
FIG. 20 shows a cross-sectional view of an embodiment configuration with a non-linear multi-tau configuration of the micromixer tubes in the fuel stage stack.

FIG. 20 shows another multi-tau configuration, in which the micromixer tubes 210 in the radial zones are provided in varying heights. Other multi-tau configuration may also be employed as preferred for the combustion needs of the industrial gas turbine.

Multi-tau micromixer tubes refer to tubes of different lengths. This is done to vary the acoustic length of the tubes, preventing combustion tones from developing based on a singular tube acoustic length. The multi-tau configuration provides another method for tuning the combustion system away from potentially damaging combustion dynamics.

The fuel stage stack shown in this application is one configuration that may be used, with three fuel stages in the fuel stage stack. There may be one or more fuel stages in the fuel stage stack. The maximum number of fuel stages is determined by the complexity of the configuration desired and combustion needs at the time.

The fuel stages may have an axial width that is needed for packaging of the micromixer tubes in each of the respective fuel stages.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustion can having a longitudinal axis in a direction of flow within the combustion can, the combustion can comprising:

a combustion chamber defined by a combustion liner;

a fuel stage stack upstream of the combustion chamber, the fuel stage stack having at least a combustion-side inner plate facing the combustion chamber, a first inner plate upstream of the combustion-side inner plate, and a second inner plate upstream of the first inner plate;

wherein an air stage is defined by the combustion-side inner plate and the first inner plate;

wherein the fuel stage stack comprises a first annular portion disposed around a first perimeter of the first inner plate, the first annular portion having a first thickness defined between a first downstream surface of the first annular portion and a first upstream surface of the first annular portion, a first plate thickness of the first inner plate being less than the first thickness;

wherein the fuel stage stack comprises a second annular portion disposed around a second perimeter of the second inner plate, the second annular portion having a second thickness defined between a second downstream surface of the second annular portion and a second upstream surface of the second annular portion, a second plate thickness of the second inner plate being less than the second thickness;

wherein the first upstream surface of the first annular portion contacts the second downstream surface of the second annular portion, thereby defining a first fuel stage between the first inner plate and the second inner plate wherein the first fuel stage defines a fuel stage width;

an endcover upstream of the fuel stage stack, such that an air plenum is defined by the endcover; and multiple micromixer tubes that fluidly connect between the air plenum and the combustion chamber, the multiple micromixer tubes extending through the fuel stage stack.

2. The combustion can of claim 1, wherein the first fuel stage comprises: a fuel inlet on a radially outermost surface of the second annular portion; and a first fuel chamber in fluid communication with the fuel inlet, the first fuel chamber being defined by the first inner plate, the second inner plate, and the second annular portion.

3. The combustion can of claim 2, wherein the second inner plate includes a first inner plate lip that extends a first width two times the fuel stage width in an axial direction relative to the longitudinal axis, the first inner plate lip forming the first fuel chamber with the first inner plate and the second inner plate, the first fuel chamber having a second width three times the fuel stage width in a radially center portion of the fuel stage stack.

4. The combustion can of claim 3, further comprising a third inner plate upstream of the second inner plate, the fuel stage stack further comprising a third annular portion disposed around a third perimeter of the third inner plate, the third annular portion abutting the second annular portion of the fuel stack, thereby defining a second fuel stage between the second inner plate and the third inner plate; wherein the third inner plate includes a second inner plate lip that extends a third width equal to the fuel stage width in the axial direction, the second inner plate lip and the first inner plate lip forming a second fuel chamber with the second inner plate and the third inner plate, the second fuel chamber having a fourth width two times the fuel stage width in a radially intermediate portion of the fuel stage stack.

5. The combustion can of claim 4, further comprising a fourth inner plate upstream of the third inner plate, the fuel stage stack further comprising a fourth annular portion disposed around a fourth perimeter of the fourth inner plate, the fourth annular portion abutting the third annular portion of the third inner plate, thereby defining a third fuel stage between the third inner plate and the fourth inner plate; wherein the fourth inner plate forms a third fuel chamber with the fourth annular portion, the third inner plate, and the second inner plate lip, the fourth fuel chamber having a fifth width equal to the fuel stage width in a radially outermost portion of the third and fourth inner plates.

6. The combustion can of claim 1, further comprising a first plurality of air channels defined around and through the first annular portion and a second plurality of air channels defined around and through the second annular portion, the first plurality of air channels being aligned with the second plurality of air channels such that a plurality of air flow passages extends through the fuel stage stack in an axial direction relative to the longitudinal axis, the plurality of air flow passages fluidly connecting with the air plenum.

7. The combustion can of claim 6, further comprising an air passage defined by a radially outer surface of the combustion liner and a radially inner surface of an outer sleeve covering the combustion liner, the air passage supplies supplying air flow through the plurality of air flow passages and to the air plenum.

8. The combustion can of claim 6, wherein the first annular portion of the first inner plate defines a set of air passageways extending radially between the first plurality of air channels and the air stage.

9. The combustion can of claim 1, wherein the combustion-side inner plate comprises a third downstream surface facing the combustion chamber and a third upstream surface opposite the downstream surface, the combustion-side inner plate defining pin holes extending from the third upstream surface to the third downstream surface that supply a cooling flow to the third downstream surface of the combustion-side inner plate.

10. The combustion can of claim 1, wherein each of the multiple micromixer tubes includes an injection hole for fuel to enter a respective one of the multiple micromixer tubes, and all of the injection holes on the multiple micromixer tubes are located on a common axial plane, the common axial plane located on an upstream portion of the multiple micromixer tubes.

11. The combustion can of claim 5, wherein the first fuel chamber, the second fuel chamber, and the third fuel chamber are separated from one another.

12. The combustion can of claim 4, wherein the multiple micromixer tubes extend through the fuel stage stack into the air stage, and the multiple micromixer tubes are provided in at least one predetermined radial zone.

13. The combustion can of claim 12, wherein a first length of at least one of the multiple micromixer tubes in a first predetermined radial zone of the at least one predetermined radial zone is different from a second length of at least one other of the micromixer tubes in a second predetermined radial zone of the at least one predetermined radial zone.

14. The combustion can of claim 12, wherein at least two of the multiple micromixer tubes within a same predetermined radial zone of the at least one predetermined radial zone have a same length.

15. The combustion can of claim 12, wherein all of the multiple micromixer tubes within a same predetermined radial zone of the at least one predetermined radial zone have a same length.

16. The combustion can of claim 12, wherein lengths of the multiple micromixer tubes are distributed in a linear configuration.

* * * * *